US007685788B1

(12) United States Patent
Torres et al.

(10) Patent No.: US 7,685,788 B1
(45) Date of Patent: Mar. 30, 2010

(54) WALL STRAP TENSIONER FOR TENSIONING A WALL STRAP OF A METAL WALL

(75) Inventors: Michael Torres, Raleigh, NC (US); Robert W. Herrmann, Raleigh, NC (US); James E. Herrmann, Raleigh, NC (US); Aaron M. Herrmann, Raleigh, NC (US); Edward R. diGirolamo, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 1378 days.

(21) Appl. No.: 10/988,032

(22) Filed: Nov. 12, 2004

(51) Int. Cl.
*E04C 3/18* (2006.01)

(52) U.S. Cl. ..... 52/573.1; 52/291; 52/657; 52/223.14; 254/243

(58) Field of Classification Search ..... 52/573.1, 52/291, 167.3, 657, 223.14, 223.13; 254/243, 254/245, 246, 248, 250, 251, 252; 29/897.32, 29/897.34, 436, 450, 452
See application file for complete search history.

(56) References Cited

U.S. PATENT DOCUMENTS 596,377 A * 12/1897 McNeill ..... 254/252
654,772 A * 7/1900 Werner ..... 254/245
834,534 A * 10/1906 Passmore ..... 254/245
905,751 A * 12/1908 Rogers ..... 254/244
1,262,301 A * 4/1918 Blest ..... 105/411
1,338,096 A * 4/1920 Richardson ..... 254/245
1,355,389 A * 10/1920 Depew ..... 254/244
2,591,352 A * 4/1952 Harbison ..... 52/291
2,779,980 A * 2/1957 Rhodes ..... 52/291
3,981,483 A * 9/1976 Rinio ..... 254/384
5,429,463 A * 7/1995 Howell ..... 410/156
5,762,455 A * 6/1998 Long ..... 410/100
6,105,937 A * 8/2000 Hay ..... 254/237
6,170,202 B1 * 1/2001 Davoodi et al. ..... 52/167.1
6,185,898 B1 * 2/2001 Pratt ..... 52/657
6,941,718 B1 * 9/2005 diGirolamo et al. ..... 52/695

* cited by examiner

*Primary Examiner*—Robert J Canfield
*Assistant Examiner*—Jessie Fonseca
(74) *Attorney, Agent, or Firm*—Coats & Bennett, P.L.L.C.

(57) ABSTRACT

A wall strap tensioner for tensioning a wall strap of a metal wall. The wall strap tensioner includes first and second links pivotally connected together. A fastener is secured to each of the first and second links for engaging and fastening to the wall strap. Disposed about the opposite end of the tensioner is a flexible cable adapted to be secured to a portion of the metal wall. A connector connects to the flexible cable and a handle is pivotally connected to the connector and movable between first and second positions. Once the handle assumes the second position, the metal strap is tensioned and can be fastened to an appropriate area of the metal wall.

21 Claims, 5 Drawing Sheets

WALL STRAP TENSIONER FOR TENSIONING A WALL STRAP OF A METAL WALL

FIELD OF THE INVENTION

The present invention relates to light steel framing structures and more particularly, to an apparatus and method for tensioning a strap that forms a part of a metal wall structure.

BACKGROUND OF THE INVENTION

Metal wall sections are commercially fabricated and delivered to construction sites for erection. Typically metal wall sections include upper and lower channel sections and a series of spaced apart metal studs extending between the upper and lower channel sections. In some cases, columns are provided about opposite end sections of the wall. Further, in some cases, the corner areas of the metal wall section are reinforced.

In many cases, it is advantageous to provide additional structure rigidity by incorporating one or more bridging members or by utilizing diagonal strapping. Diagonal straps provide rigidity to the wall section as a whole. When used in prefabricated modular wall sections these diagonal straps extend from opposed corners and cross about a center area of the wall section. Diagonal straps have applications in places other than in prefabricated wall sections. Diagonal straps are also used in conventional built-in-place modular walls.

One of the difficulties in providing prefabricated metal wall sections or conventional built-in-place metal walls with strapping is that it is difficult to effectively and efficiently tension the respective straps. First it is difficult to tension the straps manually using conventional tools. Even in cases where a great deal of care and patience is exercised, the straps are not typically fully tensioned, and accordingly, the metal wall, as a whole, lacks the desired rigidity.

Therefore, there has been and continues to be a need for an apparatus and method for efficiently and effectively tensioning and securing wall straps to sections of a metal wall.

SUMMARY OF THE INVENTION

The present invention relates to a wall strap tensioner for tensioning a wall strap of a metal building. The wall strap tensioner includes a linkage assembly having opposed first and second end portions. One or more fasteners are disposed on the first end portion for connecting the tensioner to the metal strap. The second end portion of the linkage assembly includes one or more connectors for connecting the tensioner to a structure other than the strap. The tensioner normally assumes an extended position, but is operative to be moved from the extended position to a retracted position such that the effective length of the tensioner is reduced. Further, the tensioner includes an actuator for moving the tensioner from the extended position to the retracted position so as to decrease the effective length of the tensioner.

The present invention also entails a method for tensioning a metal strap of a metal wall or wall section. This method includes attaching one portion of the tensioner to the wall strap and attaching a second portion of the tensioner to a structure or a portion of the metal wall other than the strap. Further, the method entails decreasing or shortening the effective length of the tensioner so as to tension the wall strap. After tensioning the wall strap then the wall strap is secured to the metal wall.

Other objects and advantages of the present invention will become apparent and obvious from a study of the following description and the accompanying drawings which are merely illustrative of such invention.

DESCRIPTION OF EXEMPLARY EMBODIMENT

Figure 7:
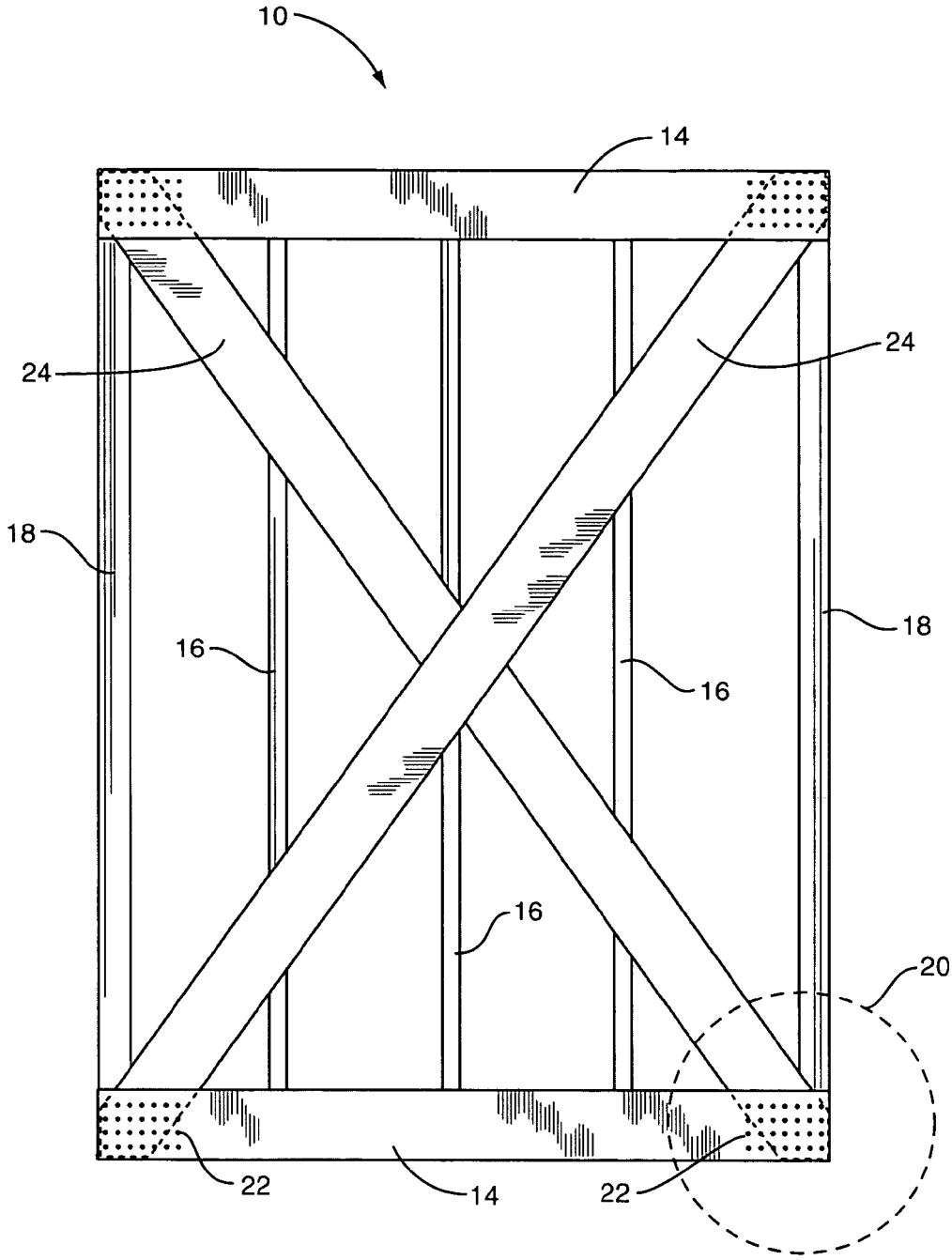
FIG. 7 is a side elevational view showing a metal wall section with two wall straps that have been tensioned and secured to the metal wall.

With further reference to the drawings, a metal wall section is shown therein and indicated generally by the numeral 10. See FIG. 7. Metal wall section 10 includes an upper channel 12 and a lower channel 14. Extending between the channels 12 and 14 is a series of metal studs 16. Disposed on opposite ends of the wall section 10 is a pair of columns 18. Columns 18 can comprise a special column structure designed to impart substantial rigidity to opposite ends or sides of the wall section. In some cases the columns 18 can be single studs, like the studs 16 referred to above, or can be a double stud arrangement. When the wall section 10 is formed, there will be defined a series of corner areas that are indicated by the numeral 20. As seen in FIG. 7, within the corner area 20 several components of the wall section come together and are joined. For example, in the corner area 20 illustrated in FIG. 7, the column 18 as well as one of the studs 16 connect to the lower channel 14. In addition, the wall section 10 is provided with a pair of diagonal straps 24. Each strap 24 includes terminal end portions that connect into the wall section 10 within a corner area 20. Metal straps 24 are conventional. They are typically secured to a portion of the upper or lower channels 12 or 14 or to some reinforcing structure associated therewith by sheet metal screws or other suitable fasteners. In conventional fashion, straps 24 reinforce the metal wall section 10 and in the case of the FIG. 7 design, tends to prevent the studs 16 and columns 18 from swaying or moving left to right.

In the FIG. 7 embodiment, a prefabricated metal wall section 10 is provided. Wall section 10 can be fabricated in a factory or plant and shipped to a construction site where the wall section or a series of like wall sections can be erected to form a wall structure or a part of a wall structure for a building. While the wall section 10 shown in FIG. 7 is in the form of a prefabricated wall section, it will be appreciated that conventional built-in-place wall sections of various length can be formed on site. Such construction can also utilize cross bracing straps 24.

The present invention deals with a method of tensioning the straps 24 and an apparatus or device for performing the tensioning. A wall strap tensioner is illustrated in FIGS. 1-6 and indicated generally by the numeral 40. As will be appreciated from subsequent portions of this disclosure, tensioner 40 is designed to be secured to a portion of a strap 24 and to be further anchored to a stationary structure or to a portion of the metal wall 10. Once secured to the strap 24, tensioner 40 can be actuated to tension the strap. Basically, tensioner 40 is designed to pull on the strap 24 and to hold the same in tension after which one end portion of the strap is fastened to the metal wall section 10. Generally, when the tensioner 40 is actuated, the effective length of the tensioner decreases and as the effective length decreases, the tensioner acts on the strap 24 and pulls the same taut.

As the drawings illustrate, the tensioner 40 disclosed herein is a compound linkage, meaning that it comprises multiple links. It includes a first end portion and a second end portion. As seen in the drawings the first end portion attaches directly to the strap 24 while the second end portion attaches to a stationary structure such as the corner area 20 of the metal wall section 10. The compound linkage that forms the tensioner 40 is designed to normally assume an extended position shown in FIG. 5, but is movable to a retracted position shown in FIG. 6. Note in FIG. 5 where the length of the tensioner is referred to as L1 while in the retracted position shown in FIG. 6, the length is referred to as L2. In the retracted position the tensioner length L2 is less than the original extended length of L1 shown in FIG. 5.

Turning to FIGS. 1-6, the tensioner 40 includes a pair of links, a first link 42 and a second link 44. Links 42 and 44 are pivotally connected by a pivot pin 104.

Figure 3:
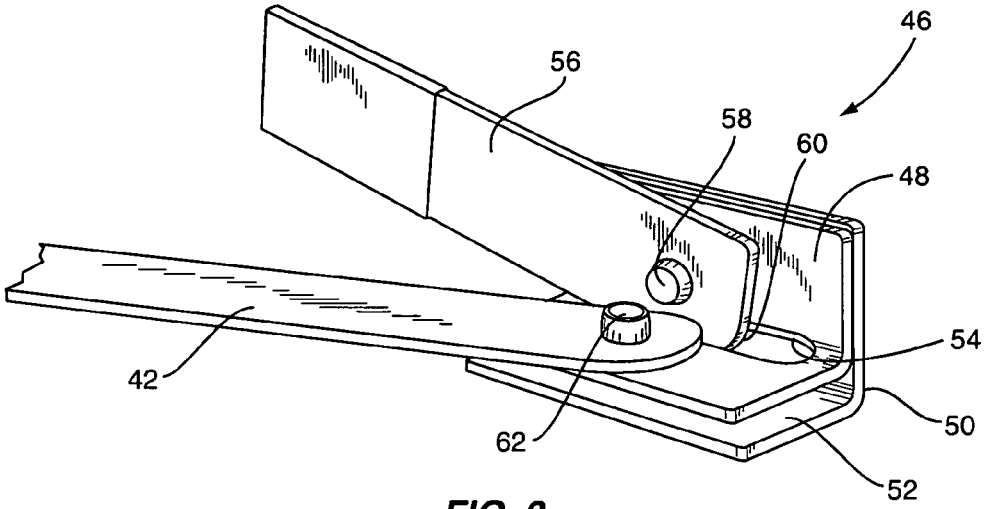
FIG. 3 is a fragmentary perspective view showing the fastening mechanism of the tensioner utilized to connect the tensioner to the metal strap.
Figure 4:
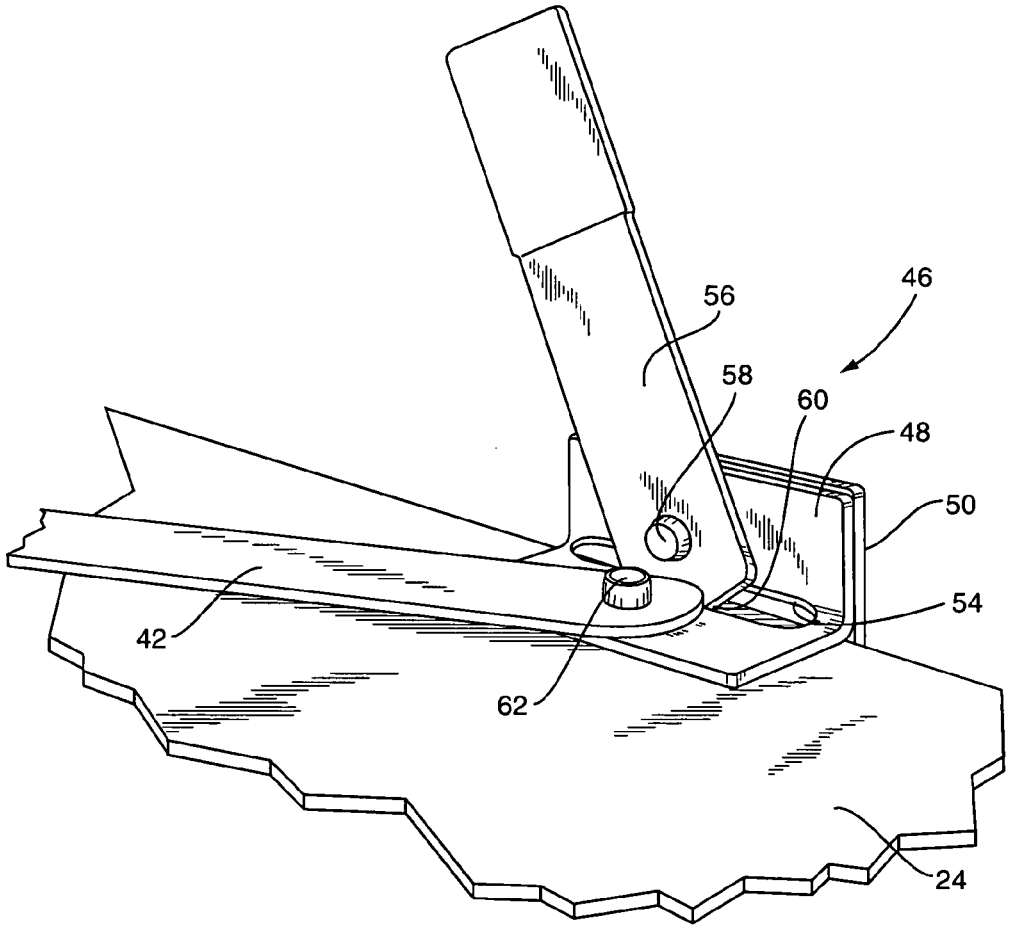
FIG. 4 is a fragmentary perspective view showing the fastener attached to a portion of the metal strap.

Secured to the terminal end of each link 42 and 44 is a fastener indicated generally by the numeral 46. Fastener 46 is designed to attach to a portion of the metal strap 24. Various fastener designs can be utilized to attach tensioner 40 to the strap 24. In the case of the embodiment illustrated in FIGS. 3 and 4, the fastener 46 includes a bracket structure that is made up of two L-shaped brackets 48 and 50. Brackets 48 and 50 are welded or secured together as illustrated in FIG. 3. When brackets 48 and 50 are secured together, there is defined an open space 52 between the lower portions of the brackets 48 and 50. See FIG. 3. Space 52 is designed to accommodate the thickness of the strap 24. In other words, strap 24 can be inserted into space 52. An opening 54 is provided in the lower portion of the inner bracket 48. A lever 56 is pivotally mounted by pivot pin 58 to the L-shaped brackets 48 and 50. Lever 56 includes a terminal end portion adjacent the pivot 58 that includes an engaging surface. Further, lever 56 is connected about the fastener such that the lower portion thereof aligns with the opening 54 in the inner bracket 48. Consequently, when lever 56 is rotated clockwise, as viewed in FIG. 3 and when a portion of the strap 24 is inserted into the space 52, it is seen that the lower engaging surface 60 of the lever 56 will engage a surface of the strap 24. As the lever 56 is continued to be rotated and turned, the lower engaging surface 60 will turn into engagement and contact with the strap 24 and will effectively pinch or secure the strap 24 in the space 52. It is further noted that each of the links 42 and 44 are pivotally connected to a respective fasteners 46 by pivot pin 62. This, of course, allows the fastener 46 to be adjusted with respect to the terminal end of the links 42 and 44.

Disposed about the opposite end of the tensioner 40 is a flexible cable 70. Cable 70 includes two ends. Secured to each end of the cable 70 is a connector 72. Connector 72 can assume various forms, but in the case of the embodiment illustrated herein, connector 72 assumes a generally Z-shape construction and is adapted to be secured into any one of the openings 22 formed in the upper and lower channels 12 and 14 within the corner areas 20. As will be appreciated from subsequent portions of the disclosure, the Z-shaped connector 72 can be inserted into an opening 22 and held therein.

Cable 70 is connected to a connector 80. Connector 80, in the case of this embodiment, is in the form of a plate, but it is understood that various types of structures can be utilized for the connector. Connector 80 includes a series of bent tabs 82 that define an area through which the cable 70 can be threaded. Effectively, tabs 82 retain the cable about the connector 80, but it is appreciated that the cable 70 can be adjusted with respect to the connector 80. That is, the cable 70 does not have to be fixed with respect to the connector 80.

Pivotally mounted to the connector 80 is a handle 90. In one embodiment, the handle 90 acts as an actuator. Handle 90 is pivotally connected to the connector 80 via a pivot pin 92. Handle 90 can be moved between a first position shown in FIG. 1 and a second position shown in FIG. 2. As will be appreciated from subsequent portions of the disclosure, when the handle is moved from the first position in FIG. 1 to the second position in FIG. 2, the effective length of the tensioner will be decreased and in the process, because the fasteners 46 attach to the strap 44, the strap will be pulled tight or tensioned.

Extending between the handle and the first and second links 42 and 44, is a connecting link indicated generally by the numeral 100. As seen in the drawings, connecting link 100 is pivotally connected to both the handle 90 and the pair of links 42 and 44. More particularly, connecting link 100 is connected to the handle via pivot pin 102 and connected to the pair of links 42 and 44 via the pivot pin 104. It will be appreciated from subsequent portions of the disclosure, the connecting link 100 is extendable and retractable, and moves between an extended position and a retracted position. More particularly, the connecting link 100 includes a pair of links 106 and 108. In some cases link 106 is referred to as a third link while link 108 is referred to as a fourth link. Note that each link includes a stop. In the case of link 106 the same includes a turned end portion 106A that functions as a stop. Likewise, link 108 includes a turned end portion 108A that functions as a stop. Thus, it is appreciated that links 106 and 108 can move with respect to each other. This is because link 106 is pivotally connected directly to the handle 90 via pivot pin 102, while link 108 is pivotally connected to the pair of links 42 and 44.

Figure 5:
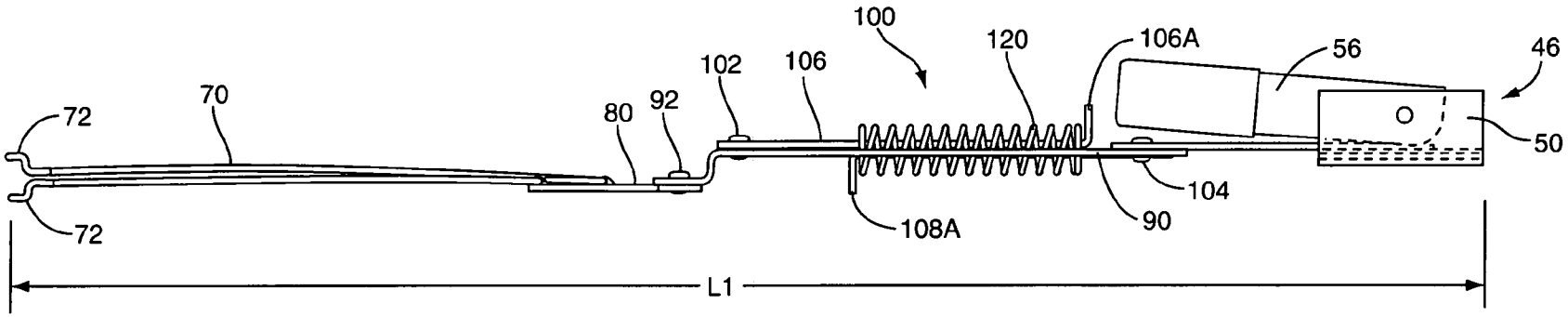
FIG. 5 is a side elevational view of the tensioner shown in the extended position.

Links 106 and 108, which constitute the connecting link 100, are held together by a coil spring 120. Note that opposed end portions of links 106 and 108 are threaded through the coil spring 120. Coil spring 120 is confined and held by the opposed stops 106A and 108A. When the links 106 and 108 assume their normal extended position, the coil spring is also extended. That is, the coil spring 120 biases the links 106 and 108 to the extended position, which is shown in FIG. 5.

Figure 2:
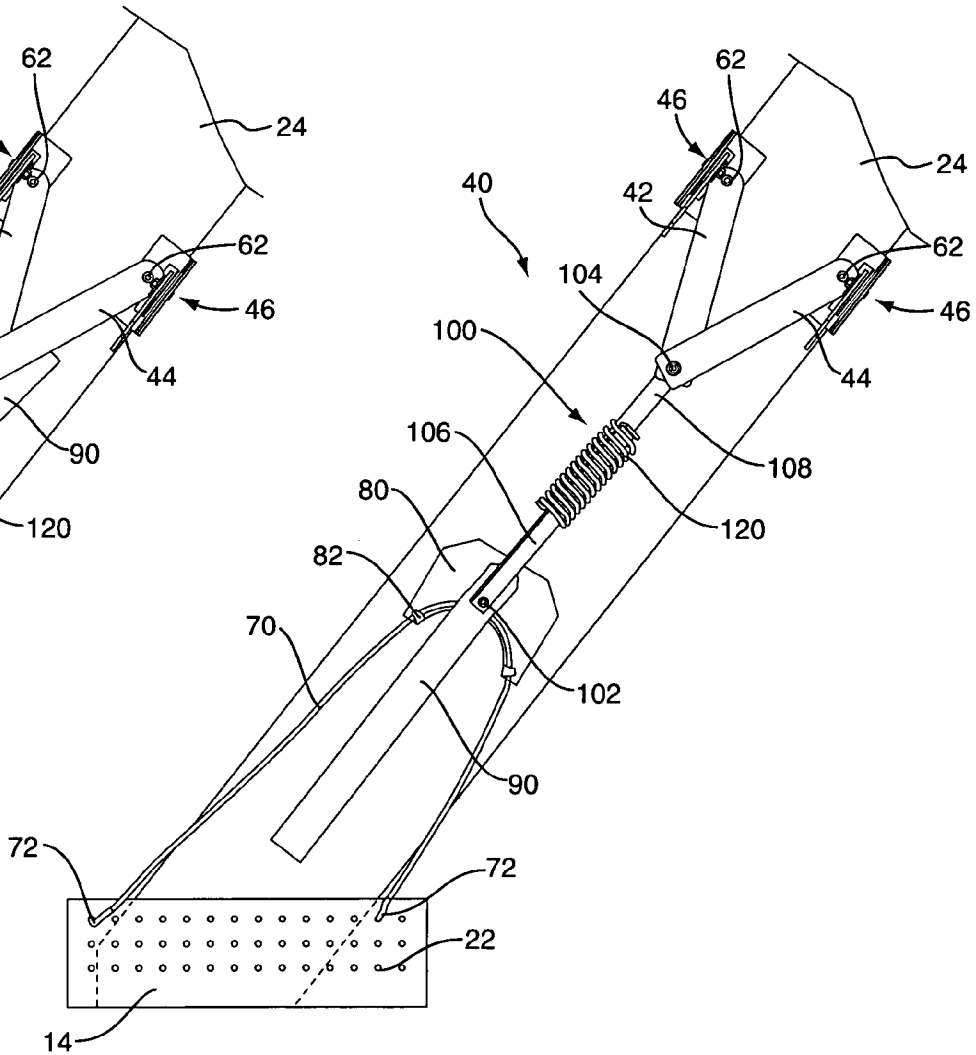
FIG. 2 is a view similar to FIG. 1 with the tensioner shown in the retracted position with the wall strap being tensioned.
Figure 1:
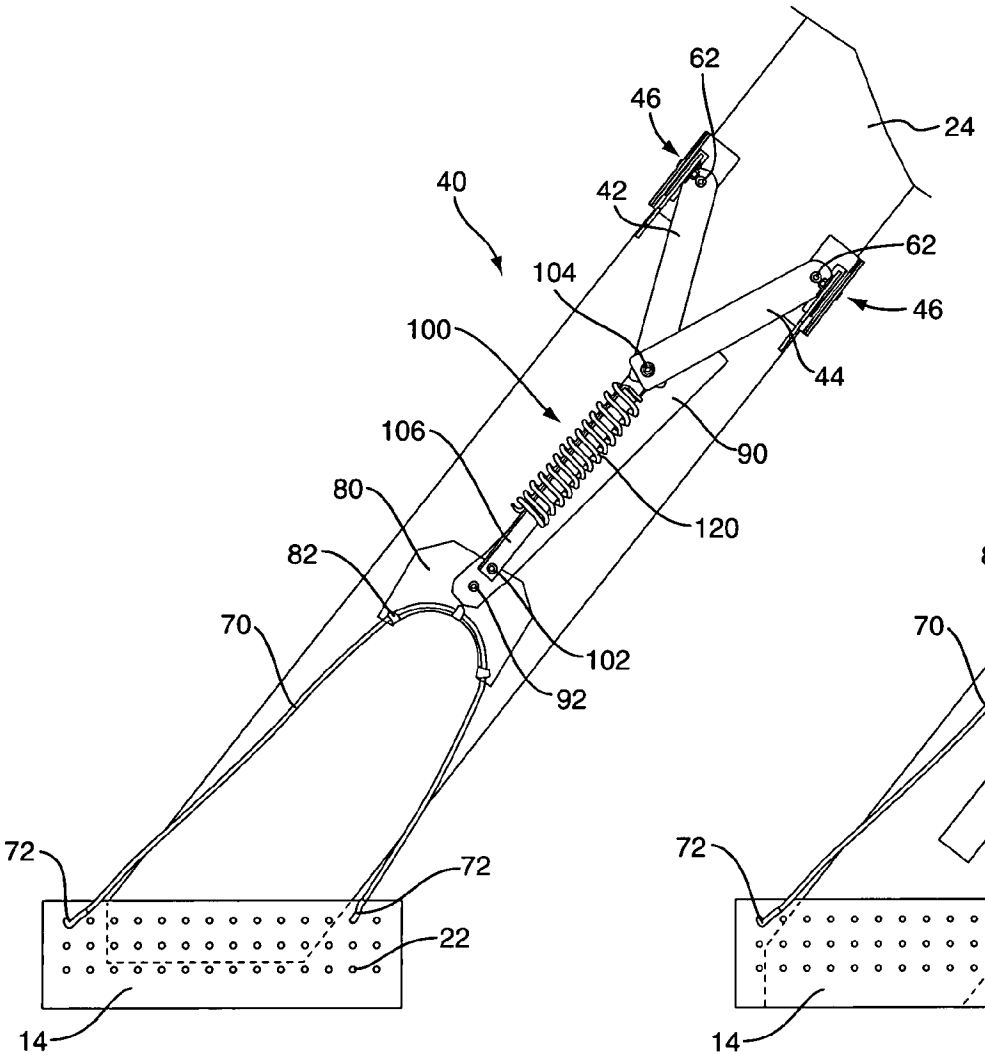
FIG. 1 a fragmentary side elevational view showing the wall strap tensioner of the present invention secured to a wall strap and disposed in the extended position.
Figure 6:
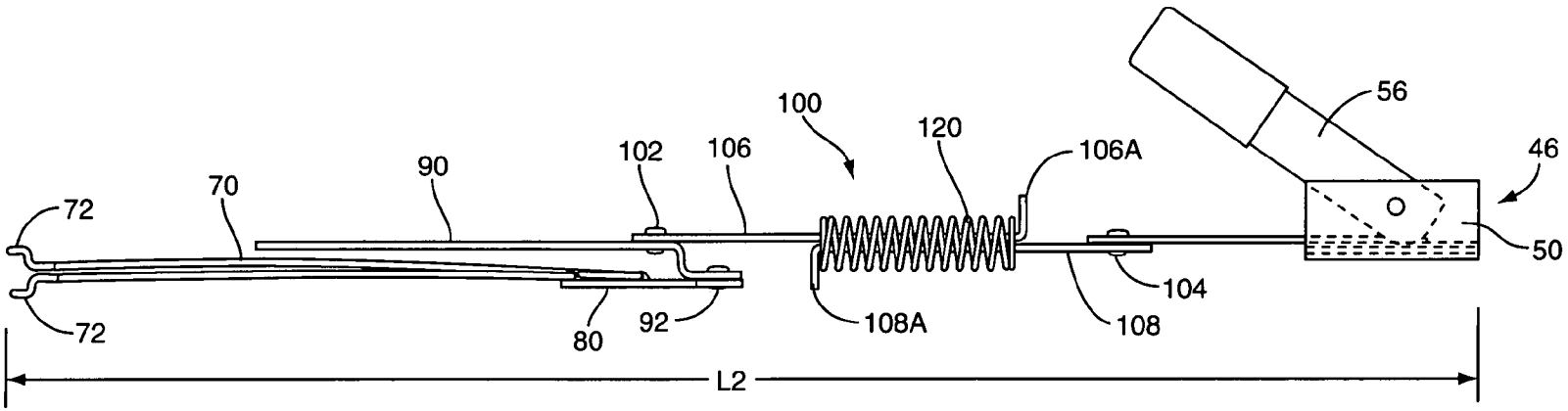
FIG. 6 is a side elevational view of the tensioner shown in the retracted position.

Links 106 and 108 are moved to the retracted position shown in FIG. 6 by rotating the handle 90 from the first position shown in FIG. 1 to the second position shown in FIG. 2. Note that as handle 90 is rotated clockwise, as viewed in FIG. 1, that the pivot pin 102 attaching the handle to link 106 tends to move generally downwardly and to the left, as viewed in FIG. 1, towards the section of the lower channel 14 that forms a part of the wall section 10. Thus, the connecting link 100 is pulled to the left, as viewed in FIGS. 5 and 6, when the handle 90 is rotated from the first position to the second position shown in FIG. 2. As the handle 90 is swung, it is appreciated that the stops 106A and 108A compress the spring 120. Even though the spring 120 is compressed, the net effect is that the connecting link, and its components 106 and 108, is moved right to left as viewed in FIGS. 5 and 6. Because of the presence of the coil spring 120, the link 108 may not move in a one-to-one correspondence with link 106. However, the strength of the spring 120 will still cause the link 108 to move right to left in FIGS. 5 and 6.

As the handle 90 is rotated, the effective length of the tensioner 40 will decrease. As shown in FIG. 5, in the extended position, the tensioner 40 includes a length L1. In the retracted position shown in FIG. 6, the tensioner 40 has a length L2. L2 is less than L1 and consequently this means that, the distance between the fasteners 46 and the connectors 72 will decrease in an application where a strap 24 is being tensioned.

Figure 8:
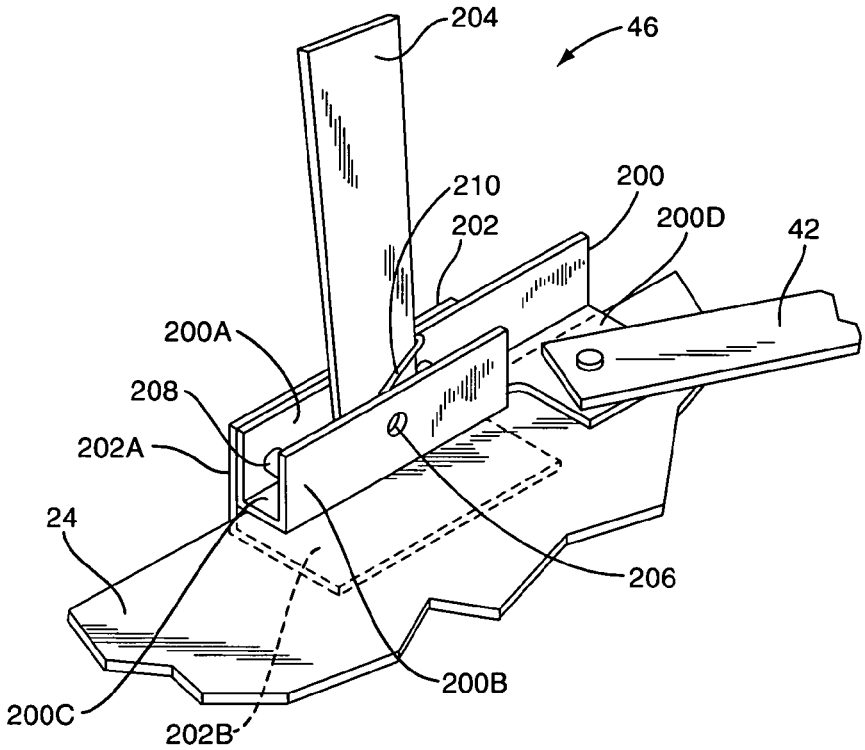
FIG. 8 is a fragmentary perspective view of an alternate design for the strap fastening mechanism.
Figure 9:
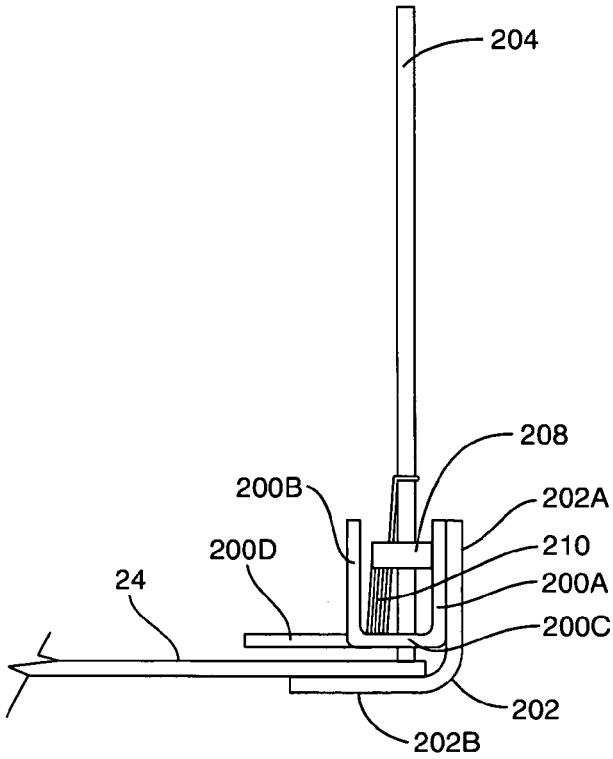
FIG. 9 is an end elevational view of the strap fastening mechanism of FIG. 8.

With reference to FIGS. 8 and 9, an alternate embodiment is shown for the fastener 46. As illustrated in FIG. 8, the fastener shown therein includes a first bracket 200. Bracket 200 includes a side 200A and a side 200B. Extending between the sides 200A and 200B is a bottom or lower portion 200C. Like the embodiment discussed above, the bottom 200C includes an opening. Projecting from side 200A, about one end portion of the bracket 200, is a tab 200D. Tab 200D is connected to link 42.

Secured to the first bracket 200 is a second bracket 202. Second bracket 202 includes a pair of sides 202A and 202B. A space is defined between the first bracket 200 and the second bracket 202. As with the prior embodiment, this space is operative to receive a portion of the strap 24.

Pivotally mounted to the first bracket 200 is a lever or handle 204. Lever 204 is pivotally mounted by a pivot pin 206. A pair of stops 208 are disposed on opposite sides of the pivot pin 200 and effectively limit the pivoting movement of lever 204. A spring 210 engages lever 204 and biases the same towards a locked or latched position. The form of spring 210 may vary, however in the case of the embodiment illustrated in FIGS. 8 and 9, the spring 210 is the form of a torsional spring and is disposed so as to engage lever 204 and to bias the same to a position where the lower terminal end of the lever will engage and pinch the strap 24 so as to secure the strap between the lower terminal edge of the lever 204 and the bottom 202B of the second bracket 202. It follows that the fastener 46 can be released from the strap 204 by pivoting the lever 204 downwardly against the bias of the spring 210.

FIGS. 1 and 2 illustrate how the tensioner 40 is used. First, one end portion, not shown in FIGS. 1 and 2, of the strap 24 is attached to a corner area 20 of the metal wall 10. Next the tensioner 40 is secured to an opposed end portion of the strap 24. This is illustrated in FIG. 1. Fasteners 46 are clamped or secured to opposite edges of the strap 24 a short distance from the end portion thereof, as shown in FIG. 1. Next, the connectors 72 formed on the end of the cable 70 are inserted into two openings 22 formed in the lower track 14 in the corner area 20 of the metal wall section 10. This is illustrated in FIG. 1. The lower left portion of the strap 24, as viewed in FIG. 1, is unattached. Then, the handle 90 is swung clockwise from the position shown in FIG. 1 to the position shown in FIG. 2. This causes the connecting link 100 to pull links 42 and 44, which in turn pull fasteners 46 towards the lower left hand corner of the metal wall 10. This effectively pulls the strap 24 tight, and once the handle 90 assumes the position shown in FIG. 2, then the end portion of the strap 24 can be screwed or otherwise connected to the lower track 14. In some cases, it is appreciated that the tensioner 40 can be used in stages to progressively increase the tension of the strap 24. That is, a first operation can be utilized to stretch the strap 24 and the strap can be secured at the end adjacent the tensioner 40. Then the tensioner 40 can be reset and the strap tensioned again, and after this stage or phase, the prior connection can be disconnected and reconnected to secure the strap in a tight configuration.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A wall strap tensioner for tensioning a wall strap of a metal wall, comprising:

a. first and second links pivotally connected together;

b. a fastener secured to each of the first and second links for fastening to the wall strap;

c. a flexible cable;

d. a connector for connecting to the flexible cable;

e. a handle pivotally connected to the connector and movable between first and second positions;

f. a connecting link extending between the first and second links and the handle, the connecting link including third and fourth links that are movable with respect to each other and which are movable between retracted and extended positions;

g. a spring associated with the third and fourth links and which is operative to bias the third and fourth links towards the retracted position; and h. wherein as the handle moves from the first and second position, the effective length of the tensioner is decreased and wherein the spring applies a biasing force as the third and fourth links tend to move from the retracted position to the extended position, and wherein as the effective length of the tensioner is reduced, the wall strap is tensioned.

2. The wall strap tensioner of claim 1 wherein the fastener includes a pinching device that engages the wall strap and pinches the wall strap.

3. The wall strap tensioner of claim 2 wherein the pinching device includes a rotatable handle that is movable between fastened and unfastened positions.

4. The wall strap tensioner of claim 3 wherein the rotatable handle includes a terminal end portion that engages and presses the wall strap against a surface when the handle assumes the fastened position.

5. The wall strap tensioner of claim 1 wherein the cable includes two ends with each end including a connector for connecting the cable to a portion of the metal wall.

6. The wall strap tensioner of claim 1 wherein the cable is adjustable with respect to the connector.

7. The wall strap tensioner of claim 1 wherein the connecting link includes opposed end portions and wherein one end portion is pivotally connected to the first and second links and the other end portion is pivotally connected to the handle.

8. The wall strap tensioner of claim 1 wherein the third and fourth links extend in side-by-side relationship and wherein the spring includes a coil spring that extends around the third and fourth links.

9. The wall strap tensioner of claim 8 wherein the third link includes a stop and the fourth link includes a stop and wherein the spring is confined between the two stops.

10. The wall strap tensioner of claim 1 wherein the third link is pivotally connected to the first and second links, and wherein the fourth link is pivotally connected to the handle, and wherein as the handle is moved from the first position to the second position the third and fourth links tend to move from a retracted position to an extended position and wherein the spring is compressed.

11. The wall strap tensioner of claim 3 including a spring for biasing the handle of the fastener.

12. The wall strap tensioner of claim 1 wherein the fastener includes a first bracket that includes a U-shaped portion, a second bracket secured to the first bracket; and a space between the first and second brackets for receiving the strap of the metal wall.

13. The wall strap fastener of claim 12 including a lever pivotally mounted in the U-shaped portion.

14. The wall strap tensioner of claim 13 including a spring for biasing the lever.

15. A wall strap tensioner for tensioning a wall strap of a metal wall comprising:

a. a linkage assembly having opposed first and second end portions;

b. one or more fasteners disposed on the first end portion for fastening to the metal strap;

c. the second end portion of the linkage assembly including one or more connectors for connecting the tensioner to a structure other than the strap;

d. the tensioner normally assuming an extended position but wherein the tensioner can be moved from the extended position to a retracted position such that the effective length of the tensioner is reduced;

e. an actuator forming a part of the tensioner for moving the tensioner from the extended position to the retracted position thereby decreasing the effective length of the tensioner such that the tensioner is operative to tension the metal strap;

f. wherein the linkage assembly includes a connecting link and wherein the connecting link includes a pair of links that are movable with respect to each other and which are themselves movable between extended and retracted positions; and g. a spring associated with the pair of links which is operative to bias the links towards the extended position.

16. The wall strap tensioner of claim 15 wherein when the tensioner assumes the retracted position, the pair of links assume an extended position where the spring acts to exert a biasing force towards the retracted position for the pair of links.

17. The wall strap tensioner of claim 16 including first and second links that are connected to the connecting link and wherein the first and second links have secured thereto a pair of fasteners for connecting to the metal strap.

18. The wall strap tensioner of claim 15 wherein the second end portion of the linkage assembly includes a flexible cable, and wherein the first end portion of the linkage assembly includes a pair of links with each link having a fastener associated therewith.

19. The wall strap tensioner of claim 15 wherein the fastener includes a pinching device.

20. The wall strap tensioner of claim 19 wherein the pinching device engages and pinches the metal strap between two surfaces.

21. The wall strap tensioner of claim 19 wherein the pinching device includes a rotatable lever and a surface, and wherein by inserting the metal strap between the lever and surface, and rotating the lever the metal strap is held between the lever and surface.

* * * * *